United States Patent [19]

Tousey

[11] 4,371,351

[45] Feb. 1, 1983

[54] MARINE STERN DRIVE COOLER

[76] Inventor: Gordon Tousey, 1856 Southwood, Muskegon, Mich. 49441

[21] Appl. No.: 876,345

[22] Filed: Feb. 9, 1978

[51] Int. Cl.[3] ..... B63H 5/12

[52] U.S. Cl. ..... 440/88

[58] Field of Search ..... 115/75, 34 R, 35, 37, 115/73; 123/41.63, 41.73, 41.82 R; 62/DIG. 10; 440/88

[56] References Cited

U.S. PATENT DOCUMENTS

| | | | |
|---|---|---|---|
| 1,328,685 | 1/1920 | Palmer | 123/41.63 |
| 2,681,029 | 6/1954 | Canazzi | 115/34 R |
| 2,766,714 | 10/1956 | Hammers | 115/73 |
| 3,046,958 | 7/1962 | Bard et al. | 123/41.63 |
| 3,137,281 | 6/1964 | Fulker | 115/75 |

*Primary Examiner*—Trygve M. Blix
*Assistant Examiner*—Jesús D. Sotelo
*Attorney, Agent, or Firm*—Price, Heneveld, Huizenga & Cooper

[57] ABSTRACT

This specification discloses a cooling apparatus for a marine stern drive unit which has a conduit for carrying water from below the water level to a position over the marine stern drive unit so that water can be sprayed on the stern drive unit. A water receiving aperture is in communication with a lower portion of the conduit and opens generally horizontally and forwardly for receiving water into the conduit. A water dispensing aperture communicates with an upper portion of the conduit and dispenses the water on the exterior of the marine stern drive unit thereby cooling a portion of the marine stern drive unit out of the water.

2 Claims, 5 Drawing Figures

MARINE STERN DRIVE COOLER

BACKGROUND OF THE INVENTION

1. Field of the Invention

This invention relates to marine stern drive units; and, in particular, to cooling apparatus for marine stern drive units.

2. Prior Art

The prior art teaches marine stern drive units which have a water intake nozzle below the water level whereby water is sucked up to cool the engine during operation. Exhaust gases from the engine are typically expelled through a portion of the stern drive unit into the water. Cooling of the marine stern drive unit is typically sufficient at an operational speed of about 500 revolutions per minute when it is almost completely submerged. As the revolutions per minute increase, the stern drive unit comes out of the water until the boat reaches a planing speed when only a lower portion of the stern drive unit is in the water. Typically, only the portion below the cavitation plate is in the water and the stern drive unit is receiving very little external cooling from the ambient water.

As a result of the above, cooling of the stern drive unit decreases at the time when the unit is operating at higher rpms and generating increased heat. In particular, the upper portion of the stern drive unit typically includes double universal joints, two pinion gears, a vertical drive shaft, and four different tapered roller bearings which all generate friction and heat. Additionally, the exhaust gases typically pass through the stern drive housing on the way from the engine to an exhaust port below water level. Thus, by increasing heat generation within the engine and reducing cooling of the engine, it is more susceptible to overheating than when operating at lower engine speeds with no planing.

As a result, while it is known to supply cooling water for cooling the internal portions of the engine, the problem of cooling a marine stern drive unit during relatively high speed operation when there is increased heat generated and reduced ambient water cooling has not been solved.

SUMMARY OF THE INVENTION

This invention teaches a cooling apparatus for a marine stern drive unit having a water conduit whereby water is brought from below the water level and dispensed on the exterior of the marine stern drive unit. The cooling apparatus has a forwardly facing, water receiving aperture below water level whereby a water moving force, such as, for example, forward motion of the boat, causes water to enter the aperture and be carried by the water conduit to above the stern drive unit and dispensed on the stern drive unit. In particular, the water is dispensed on the portion of the stern drive unit normally below water level, but above water level during planing. Thus, as the boat goes faster, more water is applied to the stern drive unit, keeping the entire housing of the stern drive unit, even the portion above water level, at the temperature of the water. Thus, cooling by the cooling apparatus increases at the time when there is additional heat from engine operation and additional cooling is particularly desirable.

DETAILED DESCRIPTION OF THE INVENTION

Figure 1:
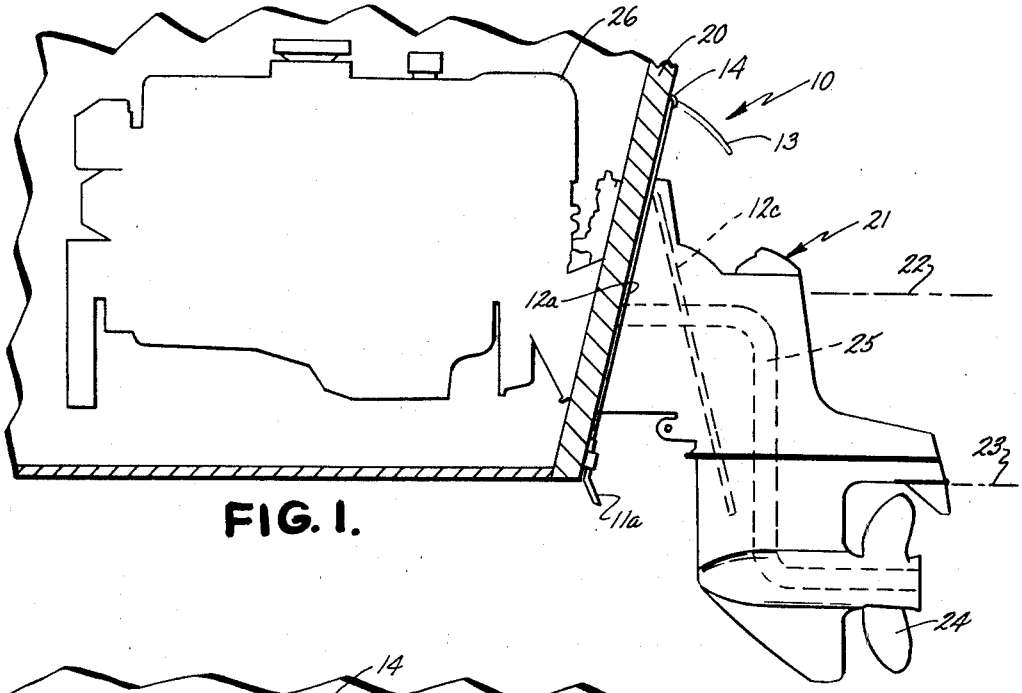
FIG. 1 is a side elevation view, partly sectional, of a boat with an engine and marine stern drive unit and a cooling apparatus in accordance with an embodiment of this invention.
Figure 2:
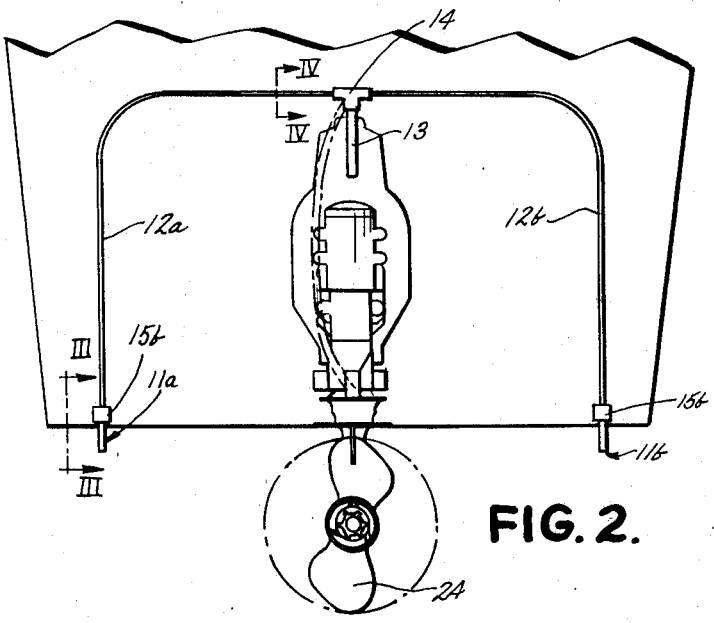
FIG. 2 is a rear elevation view of the boat engine and cooling apparatus of FIG. 1.

Referring to FIGS. 1 and 2, a marine stern drive cooler 10 includes a pair of water pickups 11*a* and 11*b*, which are mounted to the bottom portion of a boat transom 20 on either side of a marine stern drive 21 by mounting brackets 15*a* and 15*b*, respectively. Tubes 12*a* and 12*b* are in communication with and extend upward from water pickups 11*a* and 11*b*, respectively, along the outside rear of transom 20 toward a tee fitting 14 mounted on the rear, vertical centerline of transom 20 above stern drive 21. Tee fitting 14 has two input ports 40 and 41 (FIG. 5) for connection to the upper end of tubes 12*a* and 12*b* and an output port 42 coupled to a discharge tube 13 which extends out over stern drive 21 for spraying cooling water thereon. Mounting brackets 15*a* and 15*b* associated with water pickups 11*a* and 11*b* are advantageously such that water pickups 11*a* and 11*b* can pivot out of the way if struck by an underwater obstacle. In some instances only one pickup may be utilized.

When an engine 26 associated with stern drive 21 is idling or operating at low speeds, the water level is at a level 22 at which most of stern drive 21 is below the water level and cooled by the ambient water. In contrast, when the boat is planing, the water level is generally at a level 23, whereby a propeller 24 and a relatively small portion of stern drive 21 is underwater. The boat associated with marine stern drive 21 planes and the water level drops to planing level 23 because engine 26 is turning more rapidly, and transferring more mechanical motion through stern drive 21 to propeller 24. Additionally, an exhaust path 25, shown in dotted outline in FIG. 1, is carrying an increased amount of hot exhaust gases. All this combines to increase the heating of the area of stern drive 21 between levels 22 and 23. If this area is not cooled, extensive use of engine 26 at a planing speed can cause overheating and possible damage to stern drive 21 and engine 26.

Figure 3:
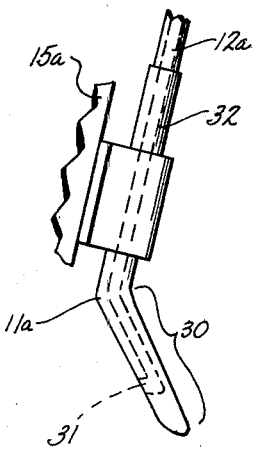
FIG. 3 is an enlarged bottom portion of a cooling apparatus taken generally along the line III—III of FIG. 2.
Figure 4:
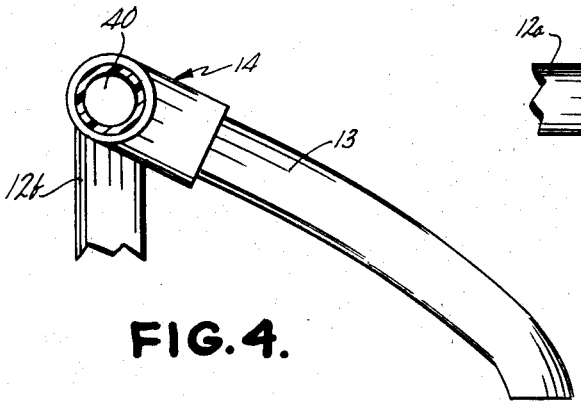
FIG. 4 is an enlarged sectional view of the top portion of the cooling apparatus in accordance with an embodiment of this invention taken generally along section line IV—IV of FIG. 2.
Figure 5:
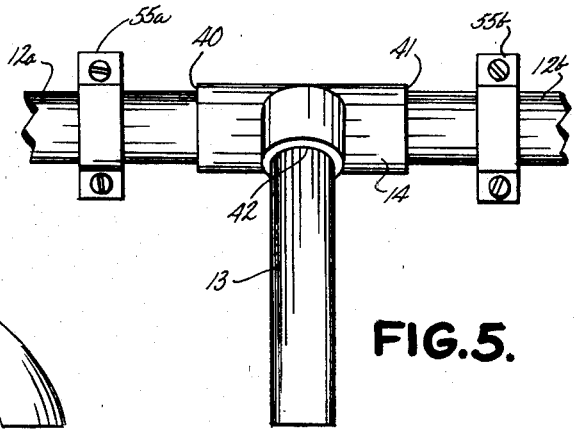
FIG. 5 is an enlarged rear elevation view of the upper portion of a cooling apparatus in accordance with an embodiment of this invention.

FIG. 3 shows an enlarged side elevation view of water pickup 11*a* including a rearwardly angled portion 30 for facilitating passage of water pickup 11 through weedy areas or other underwater obstacles. A generally forwardly facing opening 31 connects to an interior conduit 32, shown in dotted outline, for passing water received at opening 31 to tee fitting 14. Conduit 32 extends into tubing 12*a* and up to inlet port 40 of tee fitting 14 as shown in FIG. 4. The amount of water which enters opening 31 is a function of the speed of the boat and thus there is an increased flow of cooling water as the boat speed increases and heating of stern drive 21 increases. FIG. 5 shows tubing 12*b* entering the other side of tee fitting 14 at inlet port 41. Tee fitting 14 has outlet port 42 connected to tube 13 so that water which enters at inlet ports 40 and 41 exists at outlet port 42, goes through tube 13 and sprays on stern drive 21.

FIGS. 1 and 2 also show an alternative embodiment wherein a tube 12*c*, shown in phantom lines, replaces tubes 12*a* and 12*b* and taps water from a cooling passageway within stern drive 21 for discharging the water through discharge tube 13. The cooling passageway carries water within stern drive 21 from below the water level to engine 26. Thus, in the alternative embodiment water pickups 11*a* and 11*b* are not required and an existing water pickup (not shown) in marine stern drive 21 is used.

The tap into the cooling passageway can be done at any of a number of places and then the water guided through tube 13 to spray on stern drive 21. If such a tap is made and there is a single tube supplying water, tee fitting 14 can be replaced with a connection such as a brass compression elbow having a single input and a single output. Further, if stern drive 21 turns to turn the boat, the intake port of stern drive 21 will be better oriented to receive water than the intake ports of water pickups 11*a* and 11*b* which would not turn with stern drive 21 but remain oriented toward the forward part of the boat.

Typical materials for marine stern drive cooler 10 include plastic or copper for tubes 12*a* and 12*b*, copper or brass tubing for tube 13, and brass for tee fitting 14. Water pickups 11*a* and 11*b* can be a simple forwardly facing opening of a conduit or a pickup such as used for marine speedometers. One such pickup is described in U.S. Pat. No. 3,181,356, issued May 4, 1965, to William R. Carpenter the disclosure of which is herein incorporated by reference.

OPERATION

Marine stern drive cooler 10 is installed by mounting water pickups 11*a* and 11*b* with mounting brackets 15*a* and 15*b* respectively to a bottom portion of transom 20. Brackets 15*a* and 15*b* can be secured by such means as screws. Water pickups 11*a* and 11*b* must be sufficiently low so that opening 31 is below water level when the boat is planing. Tubes 12*a* and 12*b* are attached to water pickups 11*a* and 11*b* and connected to tee fitting 14. Brackets 55*a* and 55*b* are generally C-shaped positioned with flanges extending from each end. The C-shaped portion surrounds and supports the upper portion of tubes 12*a* and 12*b* and the flanges are attached to transom 20. The connection between tee fitting 14 and tubes 12*a* and 12*b* can be, for example, a compression fitting where an annular threaded member presses the extremity of the tube 12*a* or 12*b* against a portion of tee fitting 14. Tube 13 is connected to tee fitting 14 in a similar fashion. Tube 13 is adjusted so that the outlet of tube 13 is positioned to spray water on the portion of the housing of stern drive 21 so that water flows on stern drive 21 from the level 22 to the level 23 thus cooling stern drive 21. The size of the tubing required for tubes 12*a*, 12*b* and 13 is partly dependent upon the size of stern drive 21. A typical size tubing may be ¼" in diameter. However, there can, of course, be trade-offs between the diameter of the tubing and the number of tubes conducting the cooling water.

Referring to the alternative embodiment which uses tube 12*c*, an opening is formed into stern drive 21 by such means as drilling to gain access to the internal water conduit for engine 26 cooling. Tube 12*c* is connected to the opening at one end and at the other end to an elbow or fitting which is joined to tube 13. Thus, as water is pumped for cooling engine 26, some of the water enters tubing 12*c*, passes through tube 13 and is used to cool the exterior of stern drive 21.

In either of the two installations, increased engine speed, which causes increased heating, also causes increased forward motion of the stern drive 21 through the water and thus increases flow of cooling water being dispensed through the outlet of tube 13 onto the exterior of stern drive 21. Thus, there is a desirable increase in cooling when there is additional heating and not, as in the prior art, a decrease in cooling when there is an increase of heat due to increased speed.

Various modifications and variations will no doubt occur to those skilled in the various arts to which this invention pertains. For example, the particular configuration of the water pickup device from below the water level and the particular configuration of the nozzle for spraying water on the stern drive unit may be varied from that disclosed herein. These and all other variations which basically rely on the teachings through which this disclosure has advanced the art are properly considered within the scope of this invention as defined by the appended claims.

The embodiments of the invention in which an exclusive property or privilege is claimed are defined as follows:

1. A cooling apparatus for supplying cooling water to a marine stern drive for a marine vessel said drive being driven by an inboard motor and contained within a housing including:

a water pickup means, means for mounting the said water pickup means below the level of the bottom of the marine vessel with an opening facing toward the front of the marine vessel for receiving the cooling water as the marine vessel proceeds forwardly;

a water transfer tube means separate and apart from said stern drive and inboard motor and extending upwardly along the transom of the marine vessel to a position above said stern drive, said tube means being connected to said water pickup means for passing the received cooling water generally upwardly to a position substantially above the stern drive; and dispensing means including an outlet port with said water transfer tube means, said outlet port being located above and directed toward the top of said stern drive for directly passing the cooling water picked up by said water pickup means through said water transfer tube means and over the top of said stern drive housing so that cooling water runs down around the exterior surfaces of said housing for cooling the marine stern drive.

2. A cooling apparatus as recited in claim 1 wherein:

said pickup means includes a pair of water pickup devices for receiving water as the marine vessel proceeds forwardly, one of said water pickup devices being on each side of the stern drive, and said water transfer tube means includes a pair of tubular members, one connected to each one of said pickup devices, each of said tubular members extending upwardly to a position above the stern drive;

a tee fitting having a first inlet port, a second inlet port and a first outlet port, said first and second inlet ports each being connected to the upper extremity of one of said tubular members; and said dispensing means includes a dispensing nozzle connected to said first outlet port for passing cooling water from said tee fitting over the exterior surfaces of the stern drive housing.

* * * * *